US012168553B2

(12) United States Patent
Sorbara et al.

(10) Patent No.: US 12,168,553 B2
(45) Date of Patent: Dec. 17, 2024

(54) OPENING DEVICE FOR A SEALED PACKAGE AND A SEALED PACKAGE PROVIDED WITH AN OPENING DEVICE

(71) Applicant: TETRA LAVAL HOLDINGS & FINANCE S.A., Pully (CH)

(72) Inventors: Angelo Sorbara, Rubiera (IT); Rocco De Paola, Modena (IT); Franco Cani, Asti (IT); Tiziano Viani, Bibbiano (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 241 days.

(21) Appl. No.: 17/919,318

(22) PCT Filed: Apr. 19, 2021

(86) PCT No.: PCT/EP2021/060107
§ 371 (c)(1),
(2) Date: Oct. 17, 2022

(87) PCT Pub. No.: WO2021/213987
PCT Pub. Date: Oct. 28, 2021

(65) Prior Publication Data

US 2023/0150719 A1 May 18, 2023

(30) Foreign Application Priority Data

Apr. 24, 2020 (EP) ..... 20171297

(51) Int. Cl.
*B65D 5/74* (2006.01)

(52) U.S. Cl.
CPC ..... *B65D 5/748* (2013.01)

(58) Field of Classification Search
CPC ..... B65D 5/748
See application file for complete search history.

(56) References Cited

U.S. PATENT DOCUMENTS 3,927,803 A * 12/1975 Weber ..... B67B 7/26 222/91
6,279,779 B1 * 8/2001 Laciacera ..... B65D 5/748 222/541.2

(Continued)

FOREIGN PATENT DOCUMENTS

CN 101316762 A 12/2008
CN 105939938 A 9/2016

(Continued)

OTHER PUBLICATIONS

International Search Report (PCT/ISA/210) and Written Opinion (PCT/ISA/237) mailed on Jun. 29, 2021, by the European Patent Office as the International Searching Authority for International Application No. PCT/EP2021/060107.

(Continued)

*Primary Examiner* — Frederick C Nicolas
(74) *Attorney, Agent, or Firm* — BUCHANAN INGERSOLL & ROONEY PC

(57) ABSTRACT

An opening device for a sealed package containing pourable product defines an axis and includes a frame fittable about a pierceable portion of the package and defining a pour opening coaxial with axis; a cap coaxially fitted onto the frame to close the pour opening; a tubular cutter engaging the pour opening coaxially with axis and movable relative to the frame to cut the pierceable portion; and a cutter protruding from one axial end of the cutter and cooperable with the pierceable portion to unseal the package; the cutter including at least one tooth having first and second cutting faces extending transversally to axis; the tooth also including one third cutting face between the first and second cutting faces and extending transversally to the first and second cutting faces; a first edge between the third and first (Continued)

cutting faces; and a second edge between the third and second cutting faces.

13 Claims, 5 Drawing Sheets

(56) References Cited

U.S. PATENT DOCUMENTS

| | | | | |
|---|---|---|---|---|
| 6,820,764 | B2 * | 11/2004 | Miani | B65D 5/748 222/91 |
| 6,851,576 | B2 * | 2/2005 | Dubach | B65D 5/748 220/277 |
| 7,841,484 | B2 * | 11/2010 | Kaneko | B65D 5/748 408/206 |
| 8,459,478 | B2 * | 6/2013 | Alther | B65D 25/40 220/267 |
| 10,392,157 | B2 * | 8/2019 | Barron | B23D 61/028 |
| 10,676,261 | B2 * | 6/2020 | Berge | B65D 5/748 |
| 2008/0185384 | A1 | 8/2008 | Bolli | |
| 2012/0241471 | A1 | 9/2012 | Barron | |
| 2012/0248144 | A1 | 10/2012 | Barron | |
| 2014/0137717 | A1 | 5/2014 | Barron | |
| 2015/0175323 | A1 | 6/2015 | Barron | |
| 2015/0307235 | A1 | 10/2015 | Docherty et al. | |

FOREIGN PATENT DOCUMENTS

| | | | |
|---|---|---|---|
| EP | 1088764 | A1 | 4/2001 |
| EP | 1795456 | A1 | 6/2007 |
| EP | 2055640 | A1 | 5/2009 |
| JP | 2013079091 | A | 5/2013 |
| WO | 2007068094 | A1 | 6/2007 |
| WO | 2010128302 | A1 | 11/2010 |
| WO | 2011039125 | A1 | 4/2011 |
| WO | 2014012698 | A1 | 1/2014 |
| WO | 2015079416 | A1 | 6/2015 |
| WO | 2019/084647 | A1 | 5/2019 |
| WO | 2021213987 | A1 | 10/2021 |

OTHER PUBLICATIONS

Office Action (Communication of a notice of opposition) issued on Mar. 13, 2024, in corresponding European Patent Application No. 21169176.1. (37 pages).

Office Action (The First Office Action) issued May 19, 2023, by the National Intellectual Property Administration, P. R. China in corresponding Chinese Patent Application No. 202180013542.0. (6 pages).

* cited by examiner

OPENING DEVICE FOR A SEALED PACKAGE AND A SEALED PACKAGE PROVIDED WITH AN OPENING DEVICE

TECHNICAL FIELD

The present invention relates to an opening device for a sealed package containing a pourable product, in particular a liquid or pourable food product.

The present invention further relates to a sealed package containing a pourable product.

BACKGROUND ART

As commonly known, many liquid or pourable food products, such as fruit juice, UHT (ultra-high-temperature treated) milk, wine, tomato sauce, etc., are sold in packages made of sterilized packaging material.

A typical example is the parallelepiped-shaped package for pourable food products known as Tetra Brik Aseptic (registered trademark), which is made by sealing and folding a laminated web of packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Packages of this sort are normally produced on fully automatic packaging machines, on which a continuous tube is formed from the web-fed packaging material. The web of packaging material is sterilized on the packaging machine, e.g. by applying a chemical sterilizing agent, such as a hydrogen peroxide solution, which, once sterilization is completed, is removed from the surfaces of the packaging material, e.g. evaporated by heating. The web of packaging material so sterilized is maintained in a closed, sterile environment, and is folded and sealed longitudinally to form a vertical tube.

The tube is filled with the sterilized or sterile-processed food product, and is sealed and subsequently cut along equally spaced cross sections to form pillow packs, which are then folded mechanically to form respective finished, e.g. substantially parallelepiped-shaped, packages.

Alternatively, the packaging material may be cut into blanks, which are formed into packages on forming spindles, and the packages are filled with the food product and sealed. One example of this type of package is the so-called "gable-top" package known by the trade name Tetra Rex (registered trademark).

To open the above packages so as to allow the pouring of the food product, various solutions have been proposed.

In particular, an opening device for a sealed package is known which comprises a frame, fitted about a pierceable portion of the package and defining a through pour opening, a removable threaded cap, which is screwed onto the frame to close the pour opening, and a tubular cutter engaging the pour opening and having, at one axial end, triangular teeth which cooperate with the pierceable portion to unseal the package.

In detail, each triangular tooth comprises a first cutting face and a second cutting face, which are joined to one another by a single sharp cutting edge defining a pointed tip of the tooth itself.

A drawback of this kind of cutter is seen in that, due to their pointed configurations, the tips of the teeth may be damaged, for example during the manufacturing operations of the opening device.

As an example, when the cutter is manufactured by injection molding, it is normally dropped by gravity from the mold into a container. This may cause, in some cases, a deformation to the pointed tips of the teeth.

As a consequence, the interaction between the pointed tips of the teeth and the pierceable portion may be suboptimal and negatively affect the opening operation of the package.

In view of this, a need is felt within the sector for an opening device comprising a cutter, which can be effectively and reliably used for unsealing a sealed package.

DISCLOSURE OF INVENTION

It is an object of the present invention to provide an opening device for a sealed package, which allows to meet the abovementioned need in a simple and economic manner.

This object is achieved by the present invention, as it relates to an opening device as claimed in claim 1.

The invention also relates to a sealed package as claimed in claim 13.

BRIEF DESCRIPTION OF THE DRAWINGS

Two preferred, non-limiting embodiments of the present invention will be described by way of example with reference to the accompanying drawings, in which.

BEST MODES FOR CARRYING OUT THE INVENTION

Figure 1:
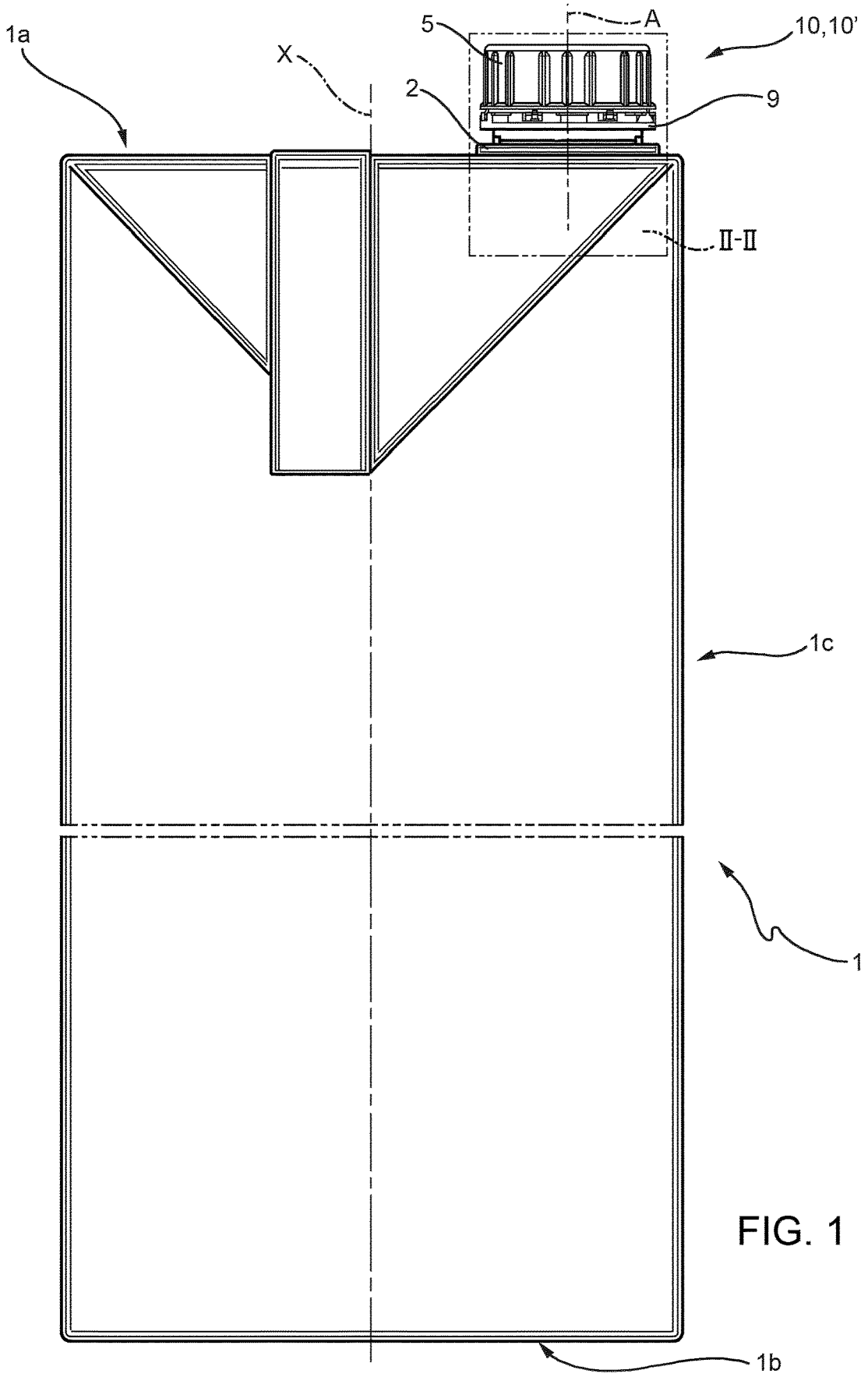
FIG. 1 shows a side view of a sealed package containing a pourable product and having an opening device according to the present invention.

Number 1 in FIG. 1 indicates as a whole a sealed package 1 for liquid or pourable products, in particular for liquid or pourable food products.

Package 1 is made of sheet packaging material, presents a vertical axis X and comprises:

- a top part 1*a*, in the present case defined by a horizontal wall;
- a bottom part 1*b*, opposite to top part 1*a* with respect to axis X and in the present case defined by a horizontal bottom wall; and a plurality of lateral walls 1*c*, extending parallel to axis X between bottom part 1*b* and top part 1*a* and which, in the present case, extend vertically.

The packaging material has a multilayer structure comprising a layer of base material, e.g. paper, covered on both sides with layers of heat-seal plastic material, e.g. polyethylene. In the case of aseptic packages for long-storage products, such as UHT milk, the packaging material also comprises a layer of oxygen-barrier material, e.g. an aluminum foil, which is superimposed on a layer of heat-seal plastic material, and is in turn covered with one or more layers of heat-seal plastic material Package 1 further comprises a pierceable portion 3 (FIG. 2), which is arranged at top part 1*a* and is at least partly detachable from the rest of the packaging material, to allow the product to be poured-out from the package 1 itself.

Alternatively, pierceable portion 3 may be arranged partly at top part 1*a* and partly at one or more of lateral walls 1*c* of package 1.

Opening device 10 is applied to package 1 by conventional fastening systems, such as adhesives, i.e. glue, or by micro flame, induction heating, ultrasound, laser, or other heat-sealing techniques.

In a preferred embodiment of the present invention, opening device 10 is applied to top part 1*a* of package 1 and is reclosable.

Alternatively, opening device 10 may be applied partly to top part 1*a* and partly to one or more of lateral walls 1*c* of package 1.

Figure 2:
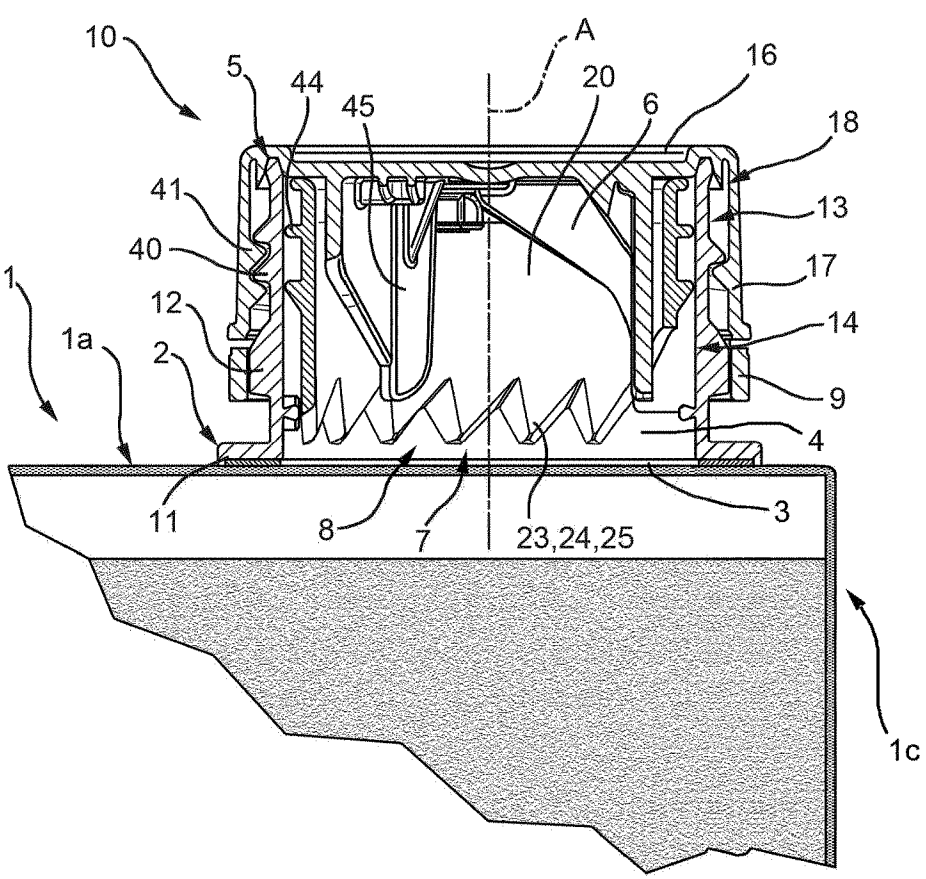
FIG. 2 is a larger-scale cross-section along plane II-II of FIG. 1.

As shown in particular in FIG. 2, opening device 10 defines an axis A and essentially comprises:

a frame 2 fitted about pierceable portion 3 of package 1, and defining a pour opening 4 for the pourable food product coaxial with axis A;

a cap 5 which is movably associated to frame 2 to close pour opening 4; and a tubular cutter 6 engaging pour opening 4 coaxially with axis A and having, at one axial end 7, cutting means 8 which are configured to cooperate with pierceable portion 3 to unseal package 1.

In one embodiment, cap 5 is associated coaxially to axis A to frame 2 and is rotatable around axis A.

In a version, cap 5 is screwable to frame 2. When cap 5 is unscrewed off frame 2 for the first time, cap 5 drives tubular cutter 6 as it will be better explained in the following.

In another version, cap 5 is rotatably coupled to frame 2 so that it rotates around axis A without moving along axis A. When cap 5 is rotated around axis A with respect to frame 2 for the first time, cap 5 drives tubular cutter 6. In this case cap 5 can comprise a base body rotatably coupled to frame 2 and a lid hinged to the base body. The lid can be moved around a hinge axis from a closed configuration to an open configuration after cap 5 has been rotated around axis A and cutter 6 has pierced pierceable portion 3.

In the embodiment shown, axis A is parallel to axis X (FIG. 1). Alternatively, axis A may be transversal to axis X.

In particular, frame 2 comprises (FIG. 2):

an annular base 11; and a cylindrical collar 12, which is coaxial with axis A, projects from annular base 11 on the opposite side to that destined to be attached to top part 1*a* of package 1 and is configured to receive cap 5.

Collar 12 comprises, in turn:

an outer surface 13, which is designed for comfortably supporting the user's mouth when consuming the food product directly from package 1; and an inner surface 14, which radially extends opposite to outer surface 13 with respect to axis A and defines pour opening 4.

Inner surface 13 and outer surface 14 are substantially cylindrical.

In addition, outer surface 13 has a thread 40.

Cap 5 comprises a circular end wall 16 and a substantially cylindrical lateral wall 17 downwardly projecting from end wall 16 and housing collar 12 of frame 2 when opening device 10 is closed (FIG. 2).

In detail, cylindrical lateral wall 17 comprises an inner surface 18 with a thread 41.

Thread 41 is configured to engage thread 40 of outer surface 13 of frame 2 when opening device 10 is closed.

Furthermore, cap 5 is formed integrally with a tamper-evidence ring 9, which is coaxially connected to cap 5 itself by means of a plurality of breakable bridges and which is destined to remain fitted to frame 2 once the bridges are broken and cap 5 is unscrewed off frame 2.

Opening device 10 also comprises (FIG. 2):

guide means 44 guiding the movement of cutter 6 with respect to frame 2; and guide means 45 guiding the movement of cutter 6 with respect to cap 5.

Guide means 44 are partly arranged on cutter 6 and partly arranged on frame 2.

Guide means 45 are partly arranged on cutter 6 and partly arranged on cap 5.

In detail, as cap 5 is unscrewed off frame 2, guide means 45 push cutter 6 towards pierceable portion 3 and guide means 44 drive cutter 6 along a predetermined piercing path through pierceable portion 3.

In the present example, guide means 44 and guide means 45 are configured to cause a rectilinear movement of cutter 6 parallel to axis A followed by a rotational movement of cutter 6 about axis A during unscrewing of cap 5 off frame 2.

According to a possible alternative not shown, guide means 44, 45 may be also configured to cause any other combination of movements of the cutter 6 towards pierceable portion 3 with respect to frame 2 and cap 5.

Figure 3:
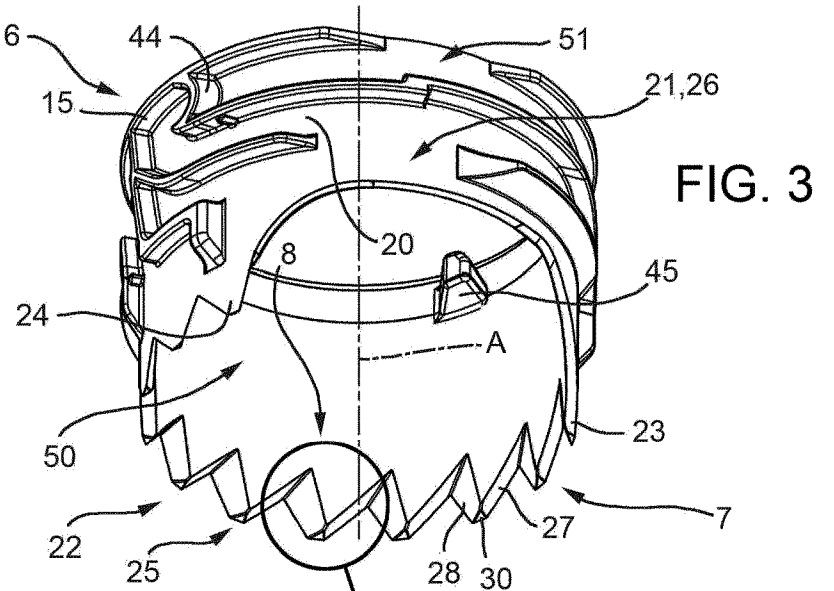
FIG. 3 is a perspective view of a cutter of the opening device of FIG. 2.

With particular reference to FIGS. 2 and 3, cutter 6 comprises a main body 20 coaxial to axis A and delimited at one axial end opposite to axial end 7 by an annular flange 15, which is perpendicular to axis A.

Main body 20 of cutter 6 comprises:

a radially inner surface 50 carrying the portion of guide means 45 arranged on cutter 6; and a radially outer surface 51, opposite to inner surface 50 and carrying the portion of guide means 44 arranged on cutter 6.

Inner surface 50 and outer surface 51 are substantially cylindrical or slightly conical and downwardly extend from annular flange 15.

In detail, when package 1 is sealed, cutter 6 is completely fitted inside collar 12 of frame 2 (FIG. 2) and axial end 7 of cutter 6 is arranged opposite to circular end wall 16 of cap 5.

When package 1 is unsealed, cutter 6 is positioned partly inside package 1 with cutting means 8, after having at least partly detached pierceable portion 3 from the rest of the packaging material.

Figure 4:
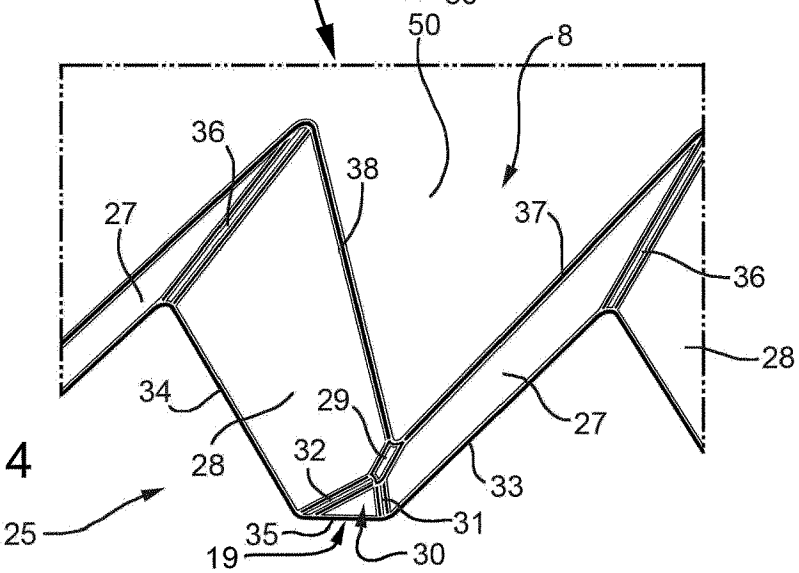
FIG. 4 is a larger-scale perspective view of a detail of the cutter of FIG. 3.

With particular reference to FIGS. 2 to 4, cutting means 8 of cutter 6 comprise a plurality of teeth 23, 24, 25 downwardly protruding from axial end 7 of main body 20 parallel to axis A and circumferentially placed side by side along a circular sector 22 of axial end 7.

In particular, moving circumferentially along circular sector 22 it is possible to define a first tooth 23 at an angular extremity of circular sector 22 and a last tooth 24 at the opposite angular extremity of circular sector 22.

In addition, a plurality of intermediate teeth 25 is circumferentially arranged between first tooth 23 and last tooth 24 along circular sector 22.

In the embodiment shown, cutting means 8 comprise eleven teeth 23, 24, 25 (FIG. 3).

Axial end 7 of main body 20 of cutter 6 further comprises a portion 21 having no cutting function, which extends along a circular sector 26 (FIG. 3).

Circular sectors 22 and 26 define together a total of 360° about axis A.

In the embodiment shown, circular sector 22 is bigger than circular sector 26. In particular, circular sector 22 has an angular extension greater than 180°.

In addition, the extension or height of cutter 6 parallel to axis A is smaller along circular sector 26 than along circular sector 22. In other words, portion 21 protrudes from main body 20 less than teeth 23, 24, 25.

Furthermore, each tooth 23, 24, 25 (see as example FIG. 4 which discloses one tooth 25) comprises:

- two cutting faces 27, 28, which are directed transversally to axis A and converge towards a free end 19 of tooth 23, 24, 25 itself; and
- an edge 29 defined by respective cutting faces 27 and 28 and extending at free end 19.

In detail, cutting faces 27, 28 are planar and are differently oriented from one another.

In addition, cutting faces 27, 28 are arranged on the side of inner surface 50 of cutter 6 and are directed transversally to inner surface 50.

In the embodiment shown, intermediate teeth 25 are equal to one another, whereas first tooth 23 and last tooth 24 are different from each other and from intermediate teeth 25.

In detail, cutting faces 27 of respective intermediate teeth 25 are sloped by congruent angles with respect to inner surface 50 and annular flange 15 of cutter 6.

Similarly, cutting faces 28 of respective intermediate teeth 25 are sloped by congruent angles with respect to inner surface 50 and annular flange 15 of cutter 6.

In the embodiment shown, moving along circular sector 22, cutting face 28 of one tooth 23, 24, 25 is adjacent to cutting face 27 of the adjacent tooth 23, 24, 25 (FIG. 4).

In detail, each tooth 23, 24, 25 is separated from the adjacent teeth by an edge 36.

Furthermore, edge 29 is rectilinear and preferably rounded.

As shown in FIG. 4, cutting face 27 of first tooth 23 and cutting face 28 of last tooth 24 are connected to portion 21 of axial end 7.

Each tooth 23, 24, 25 further comprises (FIG. 5):

- an edge 33, which is arranged between cutting face 27 and outer surface 51;
- an edge 34, which is arranged between cutting face 28 and outer surface 51;
- an edge 37, which is arranged between cutting face 27 and inner surface 50; and
- an edge 38, which is arranged between cutting face 28 and inner surface 50.

Advantageously, each tooth 23, 24, 25 comprises (FIG. 5):

- a further cutting face 30, which is circumferentially interposed between respective cutting faces 27, 28;
- an edge 31, which is arranged between cutting face 30 and cutting face 27; and
- an edge 32, which is arranged between cutting face 30 and cutting face 28.

In detail, cutting face 30 is planar and is directed transversally to cutting faces 27, 28, inner surface 50 and outer surface 51, annular flange 15 and axis A.

Similarly to cutting faces 27, 28, each cutting face 30 is arranged on the side of inner surface 50 of cutter 6.

Figure 5:
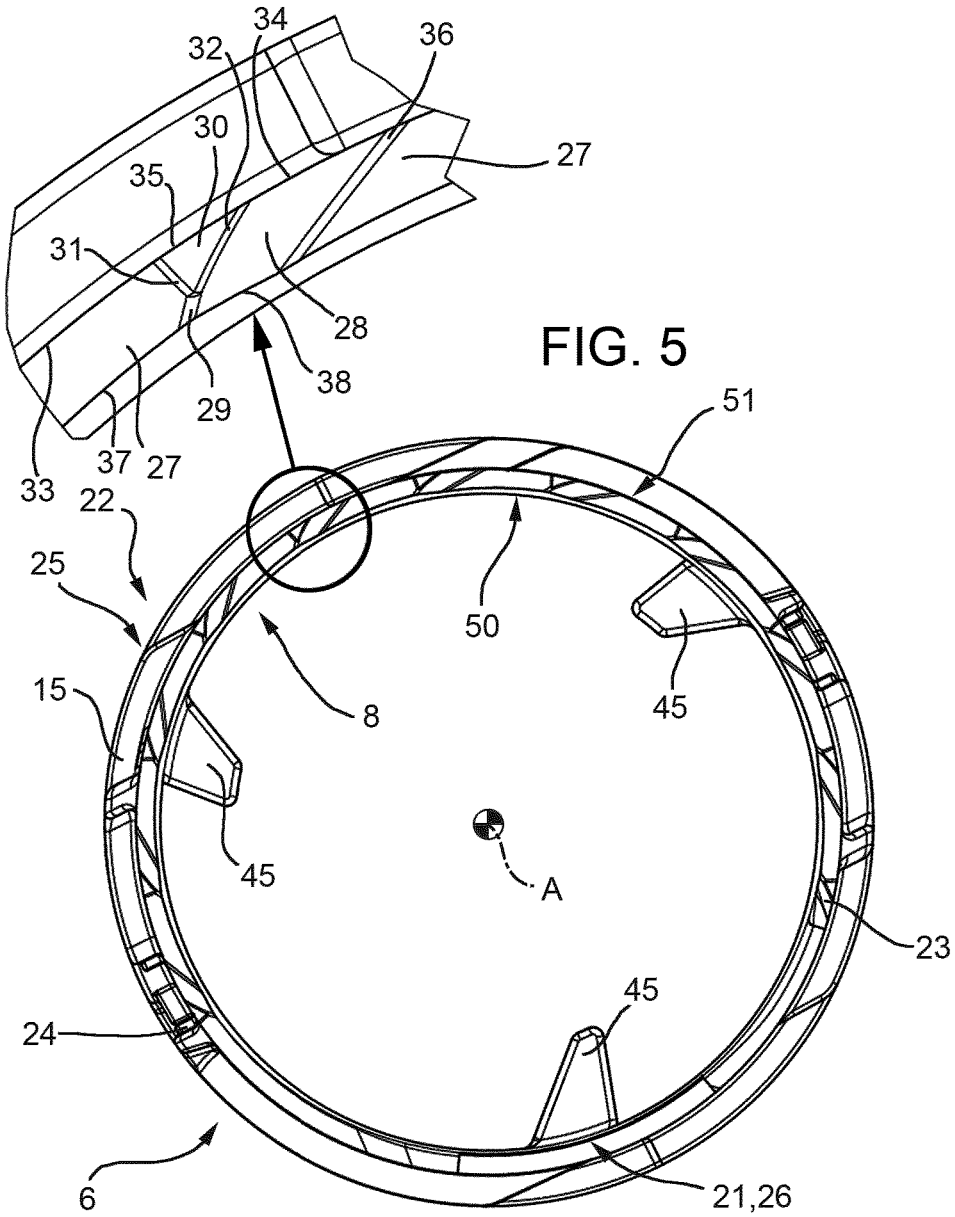
FIG. 5 is a larger-scale bottom view of the cutter of FIG. 3 with a detail thereof represented in a further enlarged view.
Figure 7:
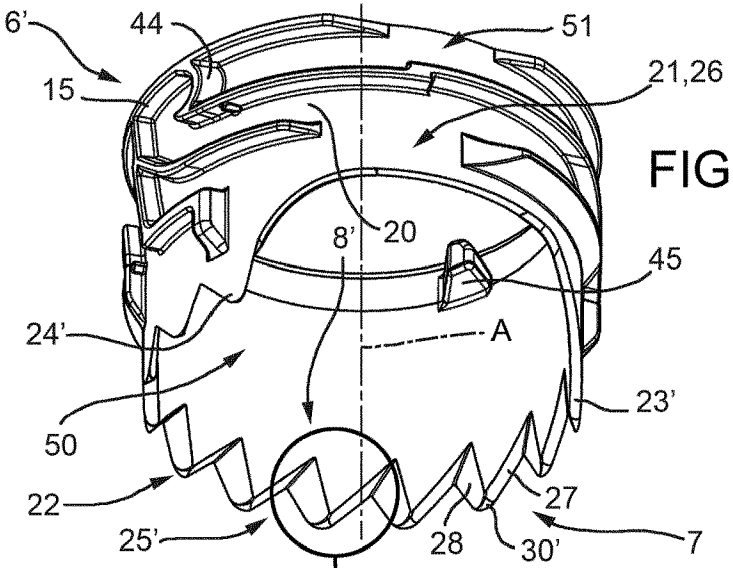
FIG. 7 is a perspective view of a cutter of the opening device of FIG. 6.
Figure 8:
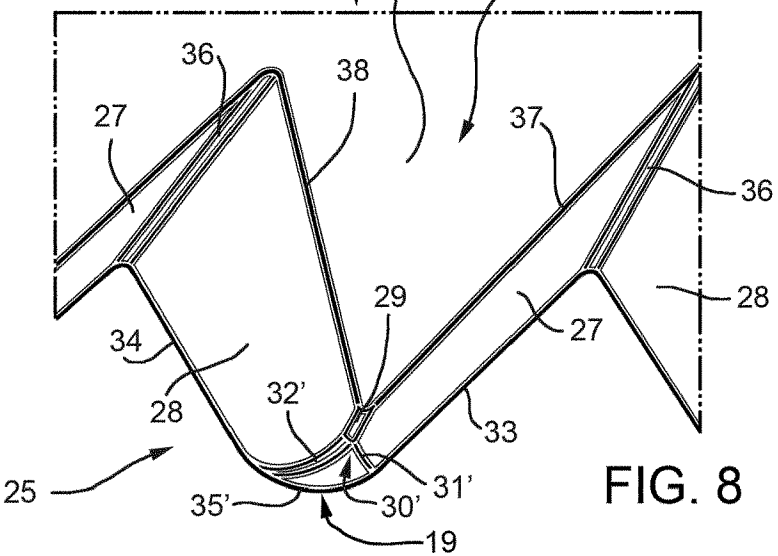
FIG. 8 is a larger-scale perspective view of a detail of the cutter of FIG. 7.

Edges 31, 32 are directed transversally to inner surface 50 and outer surface 51 and annular flange 15 (FIG. 5).

In addition, with reference to FIG. 5, edges 31, 32 of each tooth 23, 24, 25 converge into the respective edge 29.

Furthermore, edges 31, 32 are rectilinear and preferably rounded.

As shown in FIG. 5, each tooth 23, 24, 25 further comprises an edge 35, which is arranged between cutting face 30 and outer surface 51.

In the embodiment shown, edges 33, 34, 35 are rectilinear and substantially sharp.

In addition, edge 35 is the furthest portion of respective teeth 23, 24, 25 from annular flange 15 parallel to axis A and all points of edge 35 are at the same distance from annular flange 15 parallel to axis A.

In summary, each cutting face 30 is shaped like a scalene triangle having edges 31, 32 and 35 as sides.

In the embodiment shown, edge 31 is shorter than edges 32 and 35.

Furthermore, each cutting face 27 is enclosed by edges 29, 31, 33, 36 and 37; each cutting face 28 is enclosed by edges 29, 32, 34, 36 and 38.

Cutting faces 27, 28 and 30 and edges 31, 32, 33, 34, 35 of respective teeth 23, 24, 25 at least partly contribute to cut pierceable portion 3 when cutter 6 interacts with the pierceable portion 3 itself.

Preferentially but not necessarily, edge 29 is not involved in the cutting action of pierceable portion 3.

The operation of opening device 10 will now be described starting from a closed or sealed condition of the package 1.

In this condition, pierceable portion 3 is not pierced, cap 5 is screwed onto frame 2 and closes pour opening 4 and cutter 6 is completely fitted inside collar 12 of frame 2 (FIG. 2) and has teeth 23, 24, 25 spaced apart from the pierceable portion 13.

When cap 5 is rotated about axis A, thread 41 is moved with respect to thread 40 and cap 5 is progressively unscrewed off frame 2.

At the same time, guide means 45 push cutter 6 towards pierceable portion 3 and guide means 44 drive cutter 6 along the predetermined piercing path through pierceable portion 3.

As cutting means 8 of cutter 6 come into contact with pierceable portion 3, teeth 23, 24, 25 start to pierce and cut pierceable portion 3.

In particular, tooth 23 is the first to begin the cutting action on pierceable portion 3 and as the rotation of cutter 6 continues, intermediate teeth 25 and last tooth 24 start, in turn, to pierce pierceable portion 3.

Preferably, intermediate teeth 25 and last tooth 24 start to pierce pierceable portion 3 at the same time.

In detail, cutting face 30 of each tooth 23, 24, 25 is the first part that comes into contact with pierceable portion 3.

As guide means 44 feed cutter 6 through pierceable portion 3, teeth 23, 24, 25 are moved down along axis A and at least cutting faces 27, 28 and 30 of respective teeth 23, 24, 25 perform the cutting action.

In the embodiment shown, edges 31, 32, 33, 34, 35 of respective teeth 23, 24, 25 at least partially contribute to cut pierceable portion 3.

Preferably but not necessarily, edge 29 is not involved in the cutting action of pierceable portion 3.

Once cap 5 is completely unscrewed off frame 2, pierceable portion 3 is at least partly detached from the rest of the packaging material and cutter 6 is positioned partly inside package 1.

In this condition, package 1 is unsealed and the product can be poured-out through pour opening 4.

Figure 6:
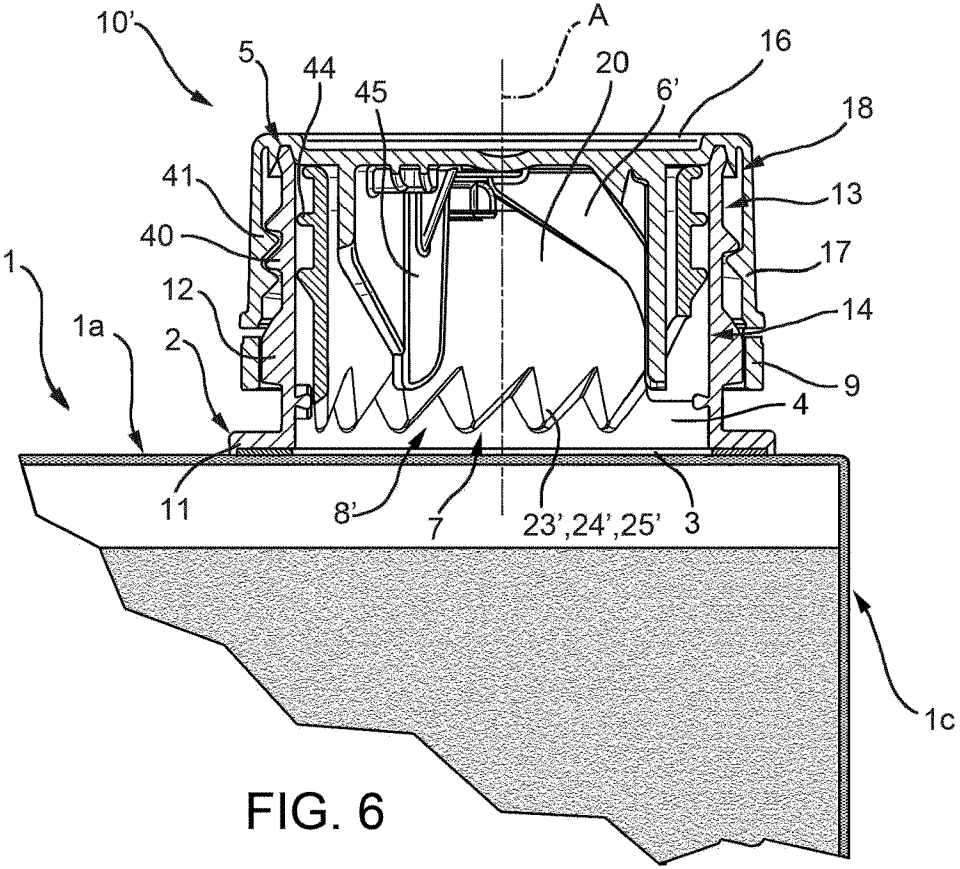
FIG. 6 is a cross-section analogous to that of FIG. 2, illustrating a different embodiment of an opening device according to the present invention.
Figure 9:
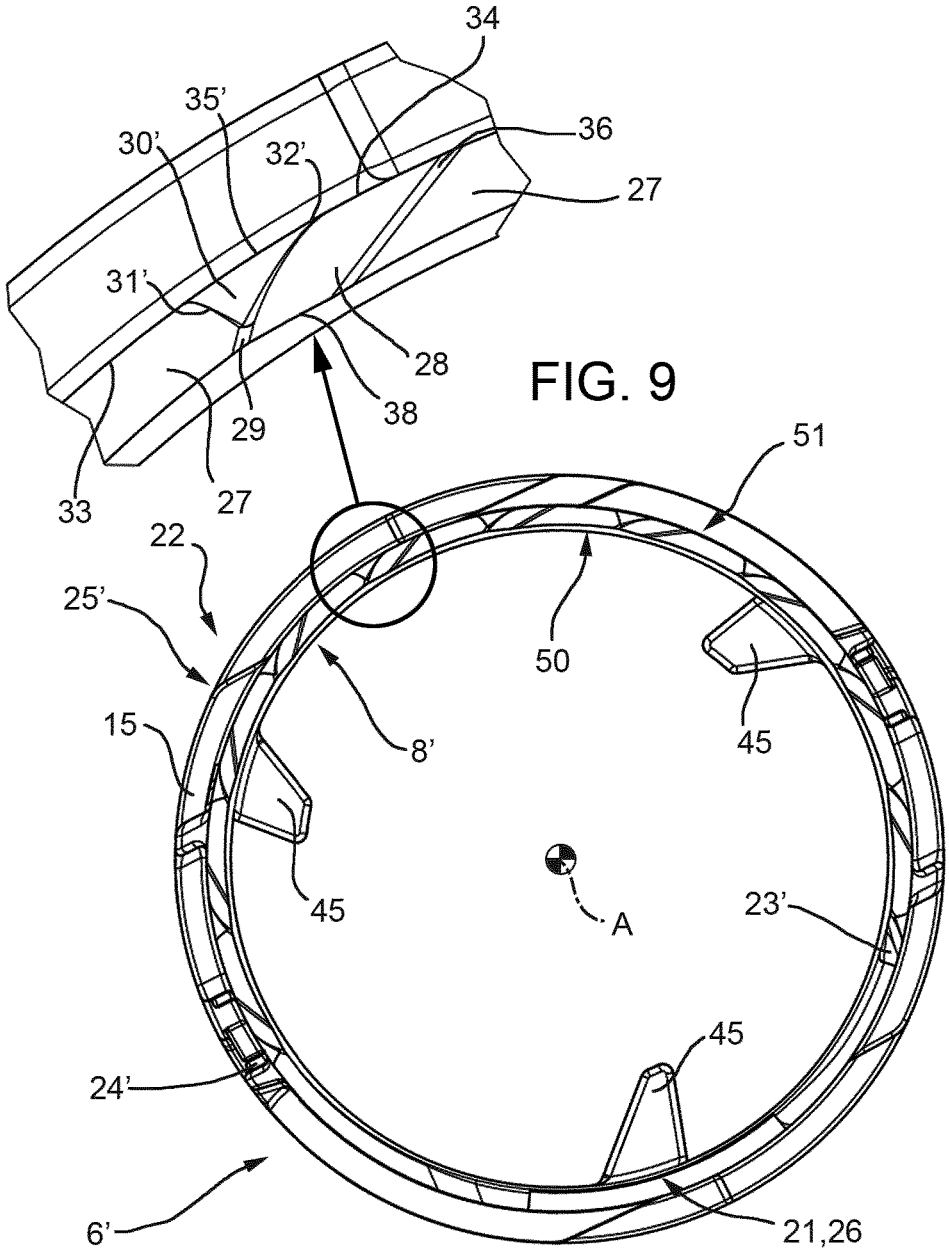
FIG. 9 is a larger-scale bottom view of the cutter of FIG. 7 with a detail thereof represented in a further enlarged view.

With reference to FIG. 6, numeral 10' indicates an opening device according to a second embodiment of the present invention.

Opening device 10' is similar to opening device 10 and will be described hereinafter only insofar as it differs therefrom; corresponding or equivalent parts of opening devices 10, 10' will be indicated where possible by the same reference numerals.

In particular, opening device 10' differs from opening device 10 in that cutting face 30' is a convex curved surface and in that edges 31', 32' and 35' are curved edges (FIGS. 6, 7, 8 and 9).

In the embodiment shown, cutting faces 30' of respective teeth 24' and 25' have the same curvature.

Similarly to edge 35, edge 35' is the furthest portion of each tooth 23', 24', 25' from annular flange 15 parallel to axis A.

In particular, since edge 35' is curved, the points of edge 35' are located at respective different distances from annular flange 15.

Furthermore, edge 31' is shorter than edges 32', 35'.

The operation of opening device 10' is similar to that of opening device 10 and is described only insofar as it differs therefrom.

In particular, as cap 5 is unscrewed off frame 2, the first part of tooth 23, 24, 25 that comes into contact with pierceable portion 3 is cutting face 30', which is a convex curved surface.

Subsequently, as guide means 44 feed cutter 6' through pierceable portion 3, teeth 23', 24', 25' are moved down along axis A and at least cutting faces 27, 28, 30' of respective teeth 23', 24', 25' perform the cutting action.

Furthermore, edges 31', 32', 35', which are curved, at least partially contribute to cut pierceable portion 3.

The advantages of opening devices 10, 10' and sealed package 1 according to the present invention will be clear from the above description.

In particular, since each tooth 23, 24, 25, 23', 24', 25' comprises cutting face 30, 30', which is circumferentially interposed between respective cutting faces 27, 28, cutter 6, 6' can be effectively and reliably used for unsealing package 1.

In fact, teeth 23, 24, 25, 23', 24, 25' are less damageable, compared to the teeth of the known opening devices discussed in the introductory part of the present description.

Cutting face 30, 30' and the particular arrangement and shape of edges 31, 32, 35, 31', 32', 35' make teeth 23, 24, 25, 23', 24', 25' robust and effective.

As a matter of fact, since cutting faces 27, 28 of each tooth 23, 24, 25, 23', 24', 25' are not divided by edge 29 only, the forces acting on each tooth as pierceable portion 3 is cut are distributed over cutting face 30, 30' and not over a single edge 29.

Cutting face 30', which is convex and curved, is particularly advantageous in this respect, because it allows a homogeneous distribution of the forces acting on the respective tooth 23, 24, 25, 23', 24', 25'.

In the final analysis, teeth 23, 24, 25, 23', 24', 25' are less deformable when compared to the teeth of the prior art cutters.

Therefore, the interaction between cutter 6, 6' and pierceable portion 3 are less likely to be negatively affected.

Finally, it is apparent that modifications and variants not departing from the scope of protection of the claims may be made to opening device 10, 10' and to package 1 according to the present invention.

In particular, two circumferentially consecutive teeth 23, 24, 25, 23', 24', 25' of cutting means 8 may be circumferentially spaced from one another along axial end 7.

Furthermore, axial end 7 may comprise more than one non-cutting portion 21.

In addition, circular sector 22 may be smaller than circular sector 26.

Furthermore, each tooth 23, 24, 25, 23', 24', 25' may comprise more than one cutting face 30, 30' other than cutting faces 27, 28.

Cutting faces 27, 28 may be at least partially curved.

The invention claimed is:

1. An opening device for a sealed package containing a pourable product, said opening device defining an axis and comprising:

a frame configured to be fitted in use about a pierceable portion of said package and defining a pour opening for the pourable product, which is coaxial with said axis;

a cap which is coaxially fitted in use onto said frame to close said pour opening;

a tubular cutter engaging said pour opening coaxially with said axis and movable in use with respect to said frame to cut said pierceable portion; and cutting means which protrude from one axial end of said tubular cutter and which cooperate, in use, with said pierceable portion to unseal said package;

said cutting means comprising at least one tooth having:

a first cutting face and a second cutting face, which extend transversally to said axis and converge towards a free end of said tooth;

at least one third cutting face, which is circumferentially interposed between said first cutting face and said second cutting face and which extends transversally to the first cutting face and the second cutting face;

a first edge, which is arranged between said third cutting face and said first cutting face; and a second edge, which is arranged between said third cutting face and said second cutting face.

2. The opening device of claim 1, wherein said first cutting face, said second cutting face and said third cutting face extend transversally to said axis.

3. The opening device of claim 1, wherein said tooth further comprises a third edge arranged between said first cutting face and said second cutting face.

4. The opening device of claim 3, wherein said third edge is rectilinear and rounded.

5. The opening device of claim 1, wherein said first cutting face and said second cutting face are planar.

6. The opening device of claim 1, wherein said third cutting face is planar.

7. The opening device of claim 1, wherein said first edge and said second edge are rectilinear and rounded.

8. The opening device of claim 1, wherein said third cutting face is a convex curved surface.

9. The opening device of claim 8, wherein said first edge and said second edge are curved.

10. The opening device of claim 1, wherein said tubular cutter comprises an inner surface and an outer surface, which are radially opposite to each other with respect to said axis; and wherein said first cutting face, said second cutting face and said third cutting face are arranged on the side of said inner surface of said cutter and are directed transversally to the inner surface itself.

11. The opening device of claim 1, wherein the at least one tooth of said cutter comprises a plurality of teeth, which are circumferentially arranged along at least a circular sector of said axial end;

said plurality of teeth comprising:

a first end tooth and a second end tooth arranged at respective angular ends of said circular sector; and a plurality of intermediate teeth, circumferentially interposed between said first end tooth and said second end tooth along said circular sector.

12. The opening device of claim 11, wherein at least said intermediate teeth are equal to one another.

13. A sealed package for pourable products that comprises the opening device according to claim 1, the sealed package comprising:

a top portion;

a bottom portion, opposite to said top portion; and a plurality of lateral walls, extending between said top portion and said bottom portion; and said sealed package comprising the pierceable portion.

* * * * *